US005100612A

United States Patent [19]

Obata et al.

[11] Patent Number: 5,100,612

[45] Date of Patent: Mar. 31, 1992

[54] SPHEROIDAL GRAPHITE CAST IRON

[75] Inventors: Fumio Obata, Kitakyusyu; Toshiaki Tanaka, Yukuhashi, both of Japan

[73] Assignee: 501 Hitachi Metals, Ltd., Tokyo, Japan

[21] Appl. No.: 540,648

[22] Filed: Jun. 19, 1990

[30] Foreign Application Priority Data

Jun. 21, 1989 [JP] Japan ..... 1-159164

[51] Int. Cl.[5] ..... C22B 4/00

[52] U.S. Cl. ..... 420/13; 420/18

[58] Field of Search ..... 420/13, 18

[56] References Cited

U.S. PATENT DOCUMENTS 2,770,871 11/1956 Demalander ..... 420/13
3,253,907 5/1966 Schwindt et al. ..... 420/13
4,971,623 11/1990 Wilford ..... 420/18

FOREIGN PATENT DOCUMENTS 61-15910 1/1986 Japan .

OTHER PUBLICATIONS

"Addition of Rare Earth Elements in the Production of Spheroidal Graphite Cast Iron and Its Practice", Jactnews No. 341, May 20, 1985, pp. 22–28, Published by Chuzo Gijutsu Rukyu Kyokai (The Casting Technology Association).

*Primary Examiner*—Upendra Roy
*Attorney, Agent, or Firm*—Finnegan, Henderson, Farabow, Garrett & Dunner

[57] ABSTRACT

Spheroidal graphite cast iron containing 0.016–0.030 weight % of S, in which the number of spheroidal graphite particles having a diameter of 2 μm or more is such that it is 1700/mm$^2$ or more when an as-cast iron portion measured has a thickness of 3 mm. This cast iron is produced by:

(a) preparing an Fe alloy melt consisting essentially of, by weight, 3.0–4.0% of C, 1.8–5.0% of Si, 1.0% or less of Mn, 0.20% or less of P, 0.005–0.015% of S and balance Fe and inevitable impurities;

(b) adding 0.020–0.050% of a lanthanide rare earth metal to the Fe alloy melt before or simultaneously with adding a spheroidizing agent;

(c) subjecting the melt to a spheroidizing treatment by using the spheroidizing agent; and (d) adding a sulfur-containing material to the melt so that the amount of S is adjusted to 0.016–0.030 weight %, and that the amount of the lanthanide rare earth metal is adjusted to 0.010–0.040 weight %.

4 Claims, 2 Drawing Sheets

(×100)

(×100)

(×100)

SPHEROIDAL GRAPHITE CAST IRON

BACKGROUND OF THE INVENTION

The present invention relates to spheroidal graphite cast iron having excellent mechanical strength and a method of producing such spheroidal graphite cast iron.

Since spheroidal graphite cast iron has excellent mechanical strength, it is widely used in various applications including automobile parts, machine parts, etc. Recently, spheroidal graphite cast iron containing a large amount of sulfur was proposed ("Addition of Rare Earth Elements in the Production of Spheroidal Graphite Cast Iron and Its Practice," JACTNEWS No. 341, pp. 22–28, published by the Chuzo Gijutsu Fukyu Kyokai (the Casting Technology Association), and Japanese Patent Laid-Open No. 61-15910). By this technology, it was made possible to produce spheroidal graphite cast iron having excellent graphitization ratio even by cupola melting.

In general, in the cupola melting method, spheroidal graphite cast iron containing a large amount of sulfur is used, making it necessary to add a large amount of a spheroidizing agent. Thus, the production costs of spheroidal graphite cast iron increase. Further, the spheroidal graphite cast iron produced by cupola melting has a relatively small number of spheroidal graphite particles per unit area, resulting in poor mechanical strength.

On the other hand, in the production of spheroidal graphite cast iron by means of an electric furnace, a melt is desulfurized such that sulfur content is 0.015% or less, or a starting Fe alloy material containing such a small amount of sulfur is used. The spheroidal graphite cast iron can be produced by using a smaller amount of a spheroidizing agent in the case of a low sulfur content melt than in the case of a high sulfur content melt.

To conduct the desulfurization of a melt, a desulfurizing agent such as carbide should be added, and since the melt is subjected to gas blowing, stirring, etc., there should be facilities for preventing the decrease in melt temperature and for preventing melt scattering. These problems cause the deterioration of environment and increase the production costs.

OBJECT AND SUMMARY OF THE INVENTION

An object of the present invention is to provide spheroidal graphite cast iron having a large number of spheroidal graphite particles per unit area, thereby showing excellent mechanical properties.

Another object of the present invention is to provide a method of producing such spheroidal graphite cast iron stably at low cost.

Thus, spheroidal graphite cast iron according to the present invention contains 0.016–0.030 weight % of S, in which the number of spheroidal graphite particles having a diameter of 2 μm or more is such that it is 1700/mm$^2$ or more when an as-cast iron portion measured has a thickness of 3 mm.

The method of producing spheroidal graphite cast iron according to the present invention comprises the steps of:

(a) preparing an Fe alloy melt consisting essentially of, by weight, 3.0–4.0% of C, 1.8–5.0% of Si, 1.0% or less of Mn, 0.20% or less of P, 0.005–0.015% of S and balance Fe and inevitable impurities;

(b) adding 0.020–0.050% of a lanthanide rare earth metal to the Fe alloy melt before or simultaneously with adding a spheroidizing agent;

(c) subjecting the melt to a spheroidizing treatment by using the spheroidizing agent; and (d) adding a sulfur-containing material to the melt so that the amount of S is adjusted to 0.016–0.030 weight %, and that the amount of the lanthanide rare earth metal is adjusted to 0.010–0.040 weight %.

DETAILED DESCRIPTION OF THE INVENTION

Figure 1:
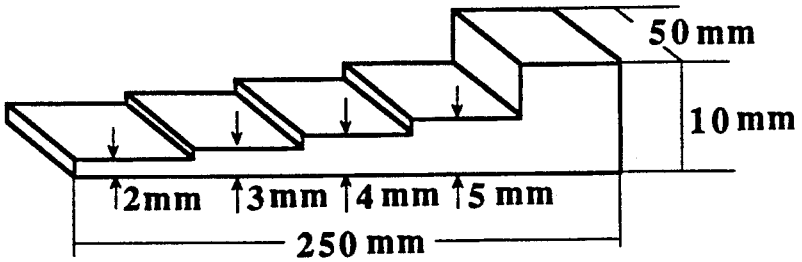
FIG. 1 is a perspective view showing a test piece having a stepwise cross section.

In the spheroidal graphite cast iron of the present invention, the first feature is a sulfur content of 0.016–0.030 weight %. When sulfur content is lower than 0.016 weight %, the number of spheroidal graphite particles per unit area is too low. Specifically, the number of spheroidal graphite particles having a diameter of 2 μm or more is 1700/mm$^2$ or less in a 3-mm portion of the as-cast spheroidal graphite cast iron product. Accordingly, the formation of chill (cementite) cannot be prevented in a cast portion as thin as 3 mm or less. This leads to poor mechanical strength. On the other hand, when the sulfur content is higher than 0.030 weight %, a spheroidization ratio of the cast iron cannot be made higher than 80%.

The second feature of the present invention is that it contains a large number of spheroidal graphite particles. Specifically, the number of spheroidal graphite particles is as large as 1700/mm$^2$ or more in an as-cast portion (thickness: 3 mm, particle ≧2 μm).

Incidentally, the number of spheroidal graphite particles decreases as the spheroidal graphite cast iron product becomes thicker. Typically, the number of spheroidal graphite particles in materials according to the present invention is as follows:

| Thickness (mm) | Number/mm$^2$ |
|---|---|
| 3 or less | 1700 or more |
| 3–10 | 800 or more |
| 10 or more | 250 or more |

In the above, the number "800 or more" in the thickness of 3–10 mm means that as the thickness of the cast iron product nears 10 mm, a lower limit of the number of spheroidal graphite particles becomes 800 or more. Accordingly, when the cast iron product is as thin as almost 3 mm, the number of spheroidal graphite particles is almost 1700 or even larger than 1700. Besides the thickness of the cast iron product, the number of spheroidal graphite particles is affected by the shape and lining of the casting mold, etc.

On the other hand, when the cast iron product is as thin as less than 3 mm, the number of spheroidal graphite particles increases only slightly or even levels off, because a thin cast iron section is rapidly cooled in the mold, resulting in the generation of chill (cementite) which suppresses the precipitation of carbon as spheroidal graphite.

Such a large number of spheroidal graphite particles can be obtained by a particular method as described below.

Incidentally, the spheroidal graphite cast iron has a composition consisting essentially of, by weight, 3.0–4.0% of C, 1.8–5.0% of Si, 1.0% or less of Mn, 0.20% or less of P, 0.016–0.030% of S, 0.02–0.06% of Mg, 0.010–0.040% of a lanthanide rare earth metal and balance Fe and inevitable impurities.

Particularly, in the case of low-carbon, high-silicon spheroidal graphite cast iron, the composition consists essentially of, by weight, 3.0–3.5% of C, 2.5–5.0% of Si, 1.0% or less of Mn, 0.20% or less of P, 0.016–0.030% of S, 0.02–0.06% of Mg, 0.010–0.040% of a lanthanide rare earth metal and balance Fe and inevitable impurities.

In the case of high-carbon, low-silicon spheroidal graphite cast iron, the composition consists essentially of, by weight, 3.4–4.0% of C, 1.8–3.3% of Si, 1.0% or less of Mn, 0.20% or less of P, 0.016–0.030% of S, 0.02–0.06% of Mg, 0.010–0.040% of a lanthanide rare earth metal and balance Fe and inevitable impurities.

With respect to the rare earth metal, it may be Ce, La, Nd, Pr or a mixture thereof. Particularly, a misch metal is preferable.

The spheroidal graphite cast iron of the present invention can be produced by (a) preparing an Fe alloy melt consisting essentially of, by weight, 3.0–4.0% of C, 1.8–5.0% of Si, 1.0% or less of Mn, 0.20% or less of P, 0.005–0.015% of S and balance Fe and inevitable impurities; (b) adding 0.020–0.050% of a lanthanide rare earth metal to the Fe alloy melt before or simultaneously with adding a spheroidizing agent; (c) subjecting the melt to a spheroidizing treatment by using the spheroidizing agent; and (d) adding a sulfur-containing material to the melt so that the amount of S is adjusted to 0.016–0.030 weight %, and that the amount of the lanthanide rare earth metal is adjusted to 0.010–0.040 weight %.

The first feature of the method according to the present invention is that an Fe alloy melt before spheroidization contains a relatively small amount of S. The amount of S should be 0.005–0.015 weight %. When the amount of S is lower than 0.005 weight %, the formation of chill (cementite) tends to occur. On the other hand, when it is higher than 0.015 weight %, the subsequent step of adding S is not effective.

The second feature of the method according to the present invention is that the melt contains 0.020–0.050 weight % of a lanthanide rare earth metal. When the amount of a rare earth metal is lower than 0.020 weight %, sufficient spheroidization cannot be achieved. On the other hand, when the amount of a rare earth metal is higher than 0.050 weight %, the number of spheroidal graphite particles cannot be increased.

The third feature of the method according to the present invention is that a sulfur-containing material is added to the melt after spheroidization. A preferred example of the sulfur-containing material is iron sulfide. The amount of the sulfur-containing material is determined such that the S content is 0.016–0.030 weight % and the rare earth content is 0.010–0.040 weight % in the resulting spheroidal graphite cast iron product.

The function of the sulfur-containing material is considered as follows: Newly added S reacts with the rare earth metal (RE) to form an RES which constitutes nuclei for spheroidal graphite. On the other hand, if all necessary sulfur is contained in the original Fe alloy melt, sufficient spheroidization cannot be achieved, resulting in a small number of spheroidal graphite particles and the formation of chill (cementite) in an as-cast thin portion. It is an outstanding discovery that the addition of the sulfur-containing material after spheroidization serves to increase the number of spheroidal graphite particles and to suppress the formation of chill (cementite) in an as-cast thin portion of the resulting spheroidal graphite cast iron product.

Incidentally, the spheroidization is conducted by adding spheroidizing agents such as Fe-Si-Mg-Ca-RE (rare earth metal), metallic Mg, etc., which are already known. The amount of the spheroidizing agent is usually 0.025–0.055 weight % when pure Mg is used.

The melt is then poured into a sand mold. The present invention is particularly effective to produce spheroidal graphite cast iron products having thin portions. In a thin cavity of the sand mold, a spheroidal graphite cast iron melt is cooled extremely rapidly, so that carbon tends to be trapped in the cast iron matrix, resulting in the formation of chill. By the method of the present invention, the formation of chill is prevented by increasing the number of spheroidal graphite particles precipitated.

The present invention will be described in further detail by means of the following Examples.

EXAMPLE 1

A cast iron melt having a composition shown in Table 1 was produced in an acid-lining arc furnace, and a part of the melt was poured into an acid-lining low-frequency induction furnace.

TABLE 1

| | | | | (weight %) | |
|---|---|---|---|---|---|
| C | Si | Mn | P | S | RE* |
| 3.21 | 1.50 | 0.20 | 0.027 | 0.028 | Tr** |

Note
*Added as misch metals.
**Trace amount.

In the acid-lining low-frequency induction furnace, 0.6% of pitch coke as a recarburizer, 0.5%, as an Si equivalent, of Fe-75% Si as an innoculant were added to adjust the composition. The melt was heated to 1500° C. At this time, the composition was as shown in Table 2:

TABLE 2

| | | | | (weight %) | |
|---|---|---|---|---|---|
| C | Si | Mn | P | S | RE |
| 3.75 | 2.00 | 0.20 | 0.028 | 0.028 | Tr |

Next, 0.15% of metallic Mg (purity: 99.9%) as a spheroidizing agent and 0.035%, as an Re equivalent, of an Fe-37% Si-31% RE alloy were added to the melt to conduct a spheroidizing treatment by a GF converter. RE was a mixture of 50% Ce, 35% La and 15% (Pr+Nd). The composition at this time was as shown in Table 3.

TABLE 3

| C | Si | Mn | P | S | (weight %) RE | Mg |
|---|---|---|---|---|---|---|
| 3.67 | 2.01 | 0.20 | 0.028 | 0.006 | 0.020 | 0.040 |

This melt was divided into two parts, and each melt part was poured into a ladel. From one ladel, a melt (No. 1) was poured into a sand mold for a Y-block test piece (cross section: 1 inch×200 mm) and a sand mold for a stepwise-cross-sectioned test piece shown in FIG. 1.

In the casting of a melt (No. 1) into a sand mold, 0.25%, based on the weight of the poured melt, of Fe-75% Si in 48–100 mesh was added to the melt.

With respect to a melt (No. 2) in another ladel, 0.015%, as a sulfur equivalent, of iron sulfide was added to the melt in the casting process. The melt was then poured into a sand mold for a Y-block test piece (cross section: 1 inch×200 mm), and a sand mold for a stepwise cross-sectioned test piece shown in FIG. 1. Incidentally, in the pouring of the melt (No. 2), 0.25%, based on the weight of the melt, of Fe-75% Si in 48–100 mesh was added.

The casting temperature was 1400° C. in both cases. At this time, the compositions were as shown in Table 4.

TABLE 4

| No. | C | Si | Mn | P | S | (weight %) RE | Mg |
|---|---|---|---|---|---|---|---|
| 1 | 3.65 | 2.18 | 0.20 | 0.028 | 0.007 | 0.020 | 0.039 |
| 2 | 3.65 | 2.19 | 0.20 | 0.027 | 0.020 | 0.019 | 0.039 |

Figure 2:
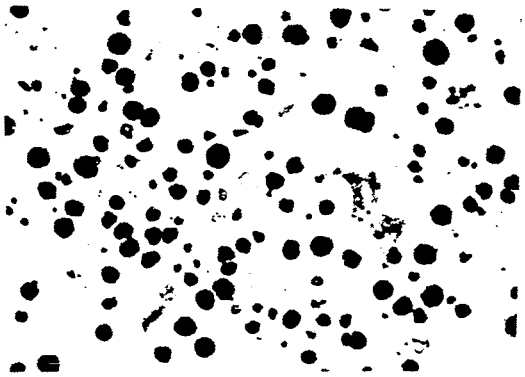
FIG. 2 is a photomicrograph (magnification: ×100) showing the metal microstructure of a test piece (No. 2) in Example 1.

The Y-block test piece was machined to obtain a tensile test piece, and a metal structure of No. 2 was photographed. Please see FIG. 2 (magnification: ×100).

With respect to the stepwise cross-sectioned test piece, a 3-mm-thick portion was measured with respect to the number of spheroidal graphite particles, spheroidization ratio and mechanical properties. The results are shown in Table 5.

TABLE 5

| No. | 1 | 2 |
|---|---|---|
| Number[1] of Spheroidal Graphite Particles per 1 mm$^2$ | 800 | 1785 |
| Spheroidization Ratio | 83.5 | 84.9 |
| Tensile Strength (kg/mm$^2$) | 48.7 | 47.8 |
| Elongation (%) | 20.2 | 23.5 |
| Brinell Hardness | 156 | 152 |

Note [1]2-μm or more graphite particles were counted.

EXAMPLE 2

The melts (Nos. 1 and 2) in Example 1 were used to produce stepwise cross-sectioned test pieces shown in FIG. 1. The number of spheroidal graphite particles was counted in each portion of test piece having a different thickness. The results are shown in FIG. 3.

Figure 3:
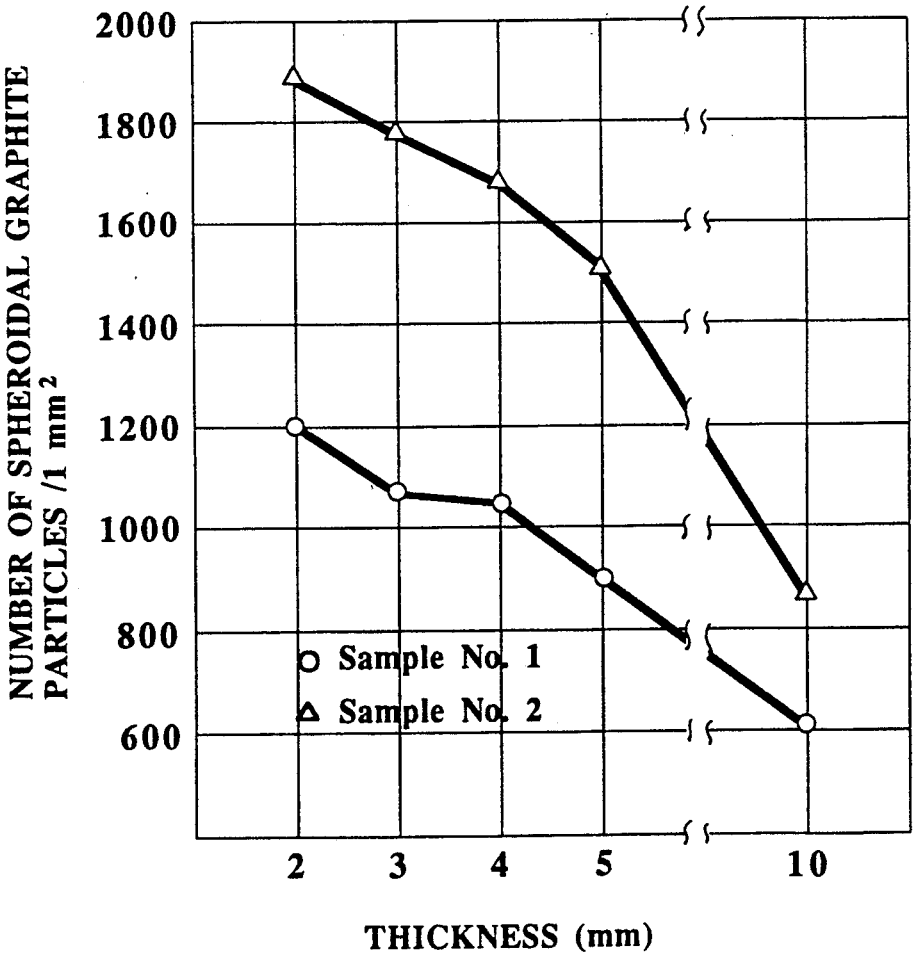
FIG. 3 is a graph showing the relation between number of spheroidal graphite particles and thickness.

It is clear from FIG. 3 that when sulfur was added after spheroidization, the resulting spheroidal graphite cast iron product contained a large number of spheroidal graphite particles.

EXAMPLE 3

A melt having a composition shown in Table 6 was produced in a high-frequency induction furnace.

TABLE 6

| C | Si | Mn | P | (weight %) S | RE |
|---|---|---|---|---|---|
| 3.68 | 1.31 | 0.24 | 0.027 | 0.006 | Tr |

1.5% of Fe-Si-5.8% Mg-3.5% Ca-2.5% RE as a spheroidizing agent and 0.6% of Fe-75% Si as an innoculant were placed at the bottom of the ladel to conduct a spheroidizing treatment. The composition of the resulting melt is shown in Table 7.

TABLE 7

| No. | C | Si | Mn | P | (weight %) S | RE |
|---|---|---|---|---|---|---|
| 3 | 3.68 | 2.35 | 0.24 | 0.027 | 0.006 | 0.035 |

Added to this melt was 0.015%, as a sulfur equivalent, of iron sulfide. The composition of the resulting melt (No. 3) was as shown in Table 8 below.

TABLE 8

| No. | C | Si | Mn | P | S | (weight %) RE | Mg |
|---|---|---|---|---|---|---|---|
| 4 | 3.62 | 2.42 | 0.24 | 0.027 | 0.020 | 0.033 | 0.037 |

This melt (No. 4) was formed into a Y-block test piece of 1 inch×250 mm in cross section. Incidentally, in the casting of the melt (No. 4) into a sand mold, 0.10–0.15%, per the amount of the melt poured, of Fe-75% Si in 48–100 mesh was added. The casting temperature at this time was 1400° C.

Figure 4:
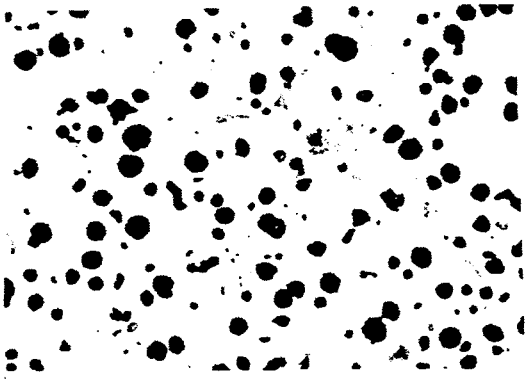
FIG. 4 is a photomicrograph (magnification: ×100) showing the metal microstructure of a test piece (No. 4) in Example 3.
Figure 5:
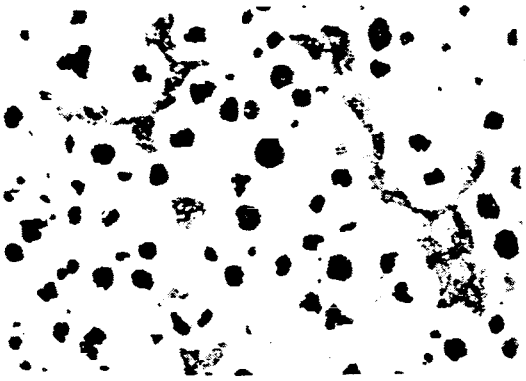
FIG. 5 is a photomicrograph (magnification: ×100) showing the metal microstructure of a test piece (No. 3) in Example 3.

The resulting test piece was machined to provide a tensile test piece, and its grip portion was microphotographed. FIG. 4 shows a photomicrograph (magnification: ×100) of the metal microstructure of the test piece obtained from Sample No. 4. For comparison, the melt (No. 3) containing 0.006% of sulfur was used to produce a test piece in the same manner, and photomicrograph was taken. The result is shown in FIG. 5 (magnification: ×100).

The number of spheroidal graphite particles, mechanical properties and spheroidization ratio of each test piece (Nos. 3, 4) are shown in Table 9.

TABLE 9

| No. | 3 | 4 |
|---|---|---|
| Number[1] of Spheroidal Graphite Particles per 1 mm$^2$ | 753 | 1752 |
| Spheroidization Ratio | 85.4 | 84.9 |
| Tensile Strength (kg/mm$^2$) | 47.2 | 48.5 |
| Elongation (%) | 20.5 | 22.7 |
| Brinell Hardness | 152 | 149 |

Note [1]2-μm or more graphite particles were counted.

As described above in detail, in the present invention, the cast iron melt containing 0.005–0.015% of sulfur and 0.020–0.050% of a lanthanide rare earth metal (RE) is spheroidized, and an additional sulfur compound is added to the melt to control the sulfur content to an amount of 0.016–0.030%, thereby causing a reaction between RE and S to form RES compounds. These compounds constitute nuclei for graphite particles, so that innoculation effects by Si compounds for graphitization are increased, leading to a larger number of spheroidal graphite particles.

Also, since a large number of spheroidal graphite particles are precipitated, shrinkage cavity can be effectively prevented even in cast iron products having complicated shapes.

The low-carbon, high-silicon spheroidal graphite cast iron obtained by this method is suitable for heat-resistant parts, and the high-carbon, low-silicon spheroidal graphite cast iron is suitable for general structural parts. In any case, the spheroidal graphite cast iron of the present invention suffers from less shrinkage cavity, and enjoys improved mechanical strength.

What is claimed is:

1. Spheroidal graphite cast iron casting having improved shrinkage resistance, the cast iron casting containing 0.016–0.030 weight % of S, in which at least 0.001 weight % of S is added after spheroidization, 0.014–0.040 weight % of a lanthanide rare earth, and in which the number of spheroidal graphite particles having a diameter of $\geqq 2$ $\mu$m is $\geqq$ about 1700/mm$^2$ when the as-cast iron casting portion measured has a thickness of 3 mm.

2. The spheroidal graphite cast iron casting according to claim 1, having a composition consisting essentially of, by weight, 3.0–4.0% of C, 1.8–5.0% of Si, 1.0% or less of Mn, 0.20% or less of P, 0.016–0.030% of S, 0.02–0.06% of Mg, 0.010–0.040% of a lanthanide rare earth metal and balance Fe and inevitable impurities.

3. The spheroidal graphite cast iron casting according to claim 1, having a composition consisting essentially of, by weight, 3.0–3.5% of C, 2.5–5.0% of Si, 1.0% or less of Mn, 0.20% or less of P, 0.016–0.030% of S, 0.02–0.06% of Mg, 0.010–0.040% of a lanthanide rare earth metal and balance Fe and inevitable impurities.

4. The spheroidal graphite cast iron casting according to claim 1, having a composition consisting essentially of, by weight, 3.4–4.0% of C, 1.8–3.3% of Si, 1.0% or less of Mn, 0.20% or less of P, 0.016–0.030% of S, 0.02–0.06% of Mg, 0.010–0.040% of a lanthanide rare earth metal and balance Fe and inevitable impurities.

* * * * *